US010539293B1

(12) United States Patent
Shackelford

(10) Patent No.: US 10,539,293 B1
(45) Date of Patent: Jan. 21, 2020

(54) PORTABLE LIGHT AND METHOD OF USE

(71) Applicant: Gina Shackelford, Chicago, IL (US)

(72) Inventor: Gina Shackelford, Chicago, IL (US)

( * ) Notice: Subject to any disclaimer, the term of this patent is extended or adjusted under 35 U.S.C. 154(b) by 0 days.

(21) Appl. No.: 16/202,720

(22) Filed: Nov. 28, 2018

Related U.S. Application Data

(60) Provisional application No. 62/591,978, filed on Nov. 29, 2017.

(51) Int. Cl.

| | |
|---|---|
| ***F21V 7/00*** | (2006.01) |
| ***F21V 14/04*** | (2006.01) |
| ***F21V 7/05*** | (2006.01) |
| ***F21S 10/06*** | (2006.01) |
| ***F21S 9/02*** | (2006.01) |
| ***F21V 23/04*** | (2006.01) |
| ***F21V 7/18*** | (2006.01) |
| ***F21Y 115/10*** | (2016.01) |

(52) U.S. Cl.
CPC ..... *F21V 7/0075* (2013.01); *F21S 9/02* (2013.01); *F21S 10/06* (2013.01); *F21V 7/05* (2013.01); *F21V 7/18* (2013.01); *F21V 14/045* (2013.01); *F21V 23/0414* (2013.01); *F21Y 2115/10* (2016.08)

(58) Field of Classification Search
CPC . F21V 7/0075; F21V 7/05; F21V 7/18; F21V 23/0414; F21S 9/02; F21S 10/06; F21Y 2115/10
See application file for complete search history.

(56) References Cited

U.S. PATENT DOCUMENTS

| | | | | |
|---|---|---|---|---|
| 4,783,725 | A | 11/1988 | Schaller | |
| 4,823,242 | A | 4/1989 | Maglica | |
| 5,105,343 | A | 4/1992 | Wakimoto | |
| 5,154,483 | A | 10/1992 | Zeller | |
| 5,446,345 | A | 8/1995 | Halabi | |
| 5,681,106 | A | 10/1997 | Coultas | |
| 5,816,883 | A | 10/1998 | Holland | |
| 5,954,416 | A | 9/1999 | Peterson | |
| D490,924 | S | 6/2004 | Jigamian | |
| 7,422,344 | B2 * | 9/2008 | Wu | F21L 4/027 362/184 |
| 2004/0264852 | A1 * | 12/2004 | Tang | G02B 6/0008 385/31 |
| 2008/0174990 | A1 * | 7/2008 | Tuck | F21L 4/005 362/198 |
| 2013/0308308 | A1 * | 11/2013 | Pritchett | F21V 7/0075 362/184 |
| 2016/0252237 | A1 | 9/2016 | Brown et al. | |
| 2018/0283622 | A1 | 10/2018 | Weyand | |

FOREIGN PATENT DOCUMENTS

| | | |
|---|---|---|
| EP | 0468822 A2 | 7/1990 |
| FR | 2809796 A1 | 7/2001 |
| KR | 101843128 81 | 3/2018 |

* cited by examiner

*Primary Examiner* — Mary Ellen Bowman
(74) *Attorney, Agent, or Firm* — Genna S. Hibbs; Hibbs Law, LLC

(57) ABSTRACT

This invention relates to a new way to signal or display light by way of a portable light device that includes a reflector structure with a flexible and floppy end. The flexible and floppy end contains reflectors or reflective pieces or reflective fabric such that the light is reflected in many directions when the devices is waved around by a user.

14 Claims, 7 Drawing Sheets

PORTABLE LIGHT AND METHOD OF USE

CROSS REFERENCE

This application is the non-provisional, utility application for and claims the benefit of provisional application No. 62/591,978, titled, "PRAISE LIGHTS," filed 29 Nov. 2018, by inventor Gina Shackelford, and is incorporated here by reference, including the specifications. This is not a conversion of the provisional, but a new application.

BRIEF DESCRIPTION OF DRAWINGS

Non-limiting and non-exhaustive examples of several of the various embodiments of the present invention are described with references to the following figures, and reference numbers refer to the same features throughout the various views and embodiments unless otherwise specified.

FIG. 6*b* shows a possible embodiment with the light inside the hollow housing body, and a flexible skirt with pleated flexible base rather than flexible strips.

Figure 1:
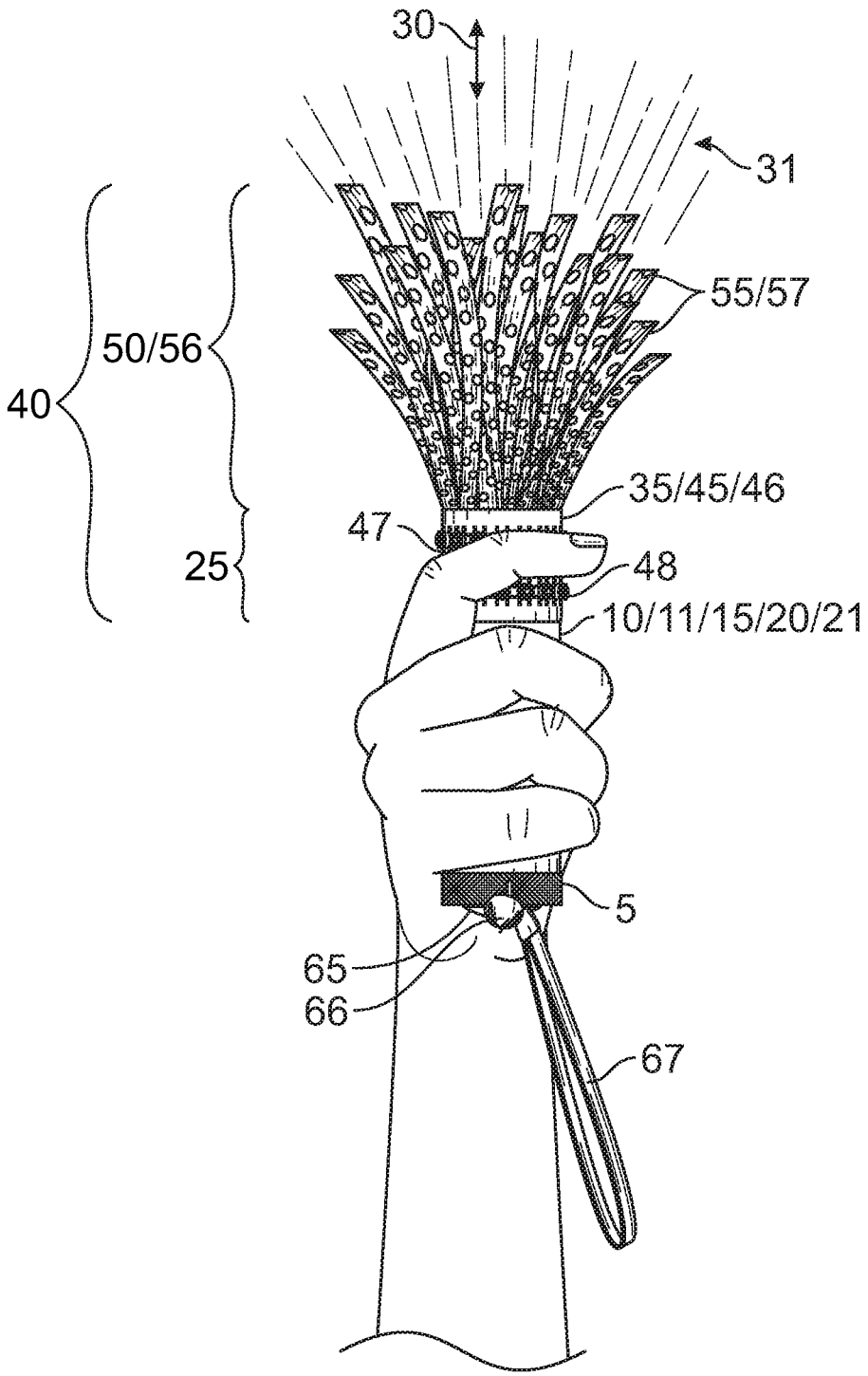
FIG. 1 is an example illustration of an embodiment of the invention in use/motion, showing the flexible reflector structure interacting with light emitted from the body.

Corresponding reference characters indicate corresponding components throughout the several views of the drawings. Skilled artisans will appreciate that elements in the figures are illustrated for simplicity and clarity and have not necessarily been drawn to scale. Also, common but well-understood elements that are useful or necessary in a commercially feasible embodiment are often not depicted in order to facilitate a less obstructed view of these various embodiments. For example, the components for a "light" (defined below), like a battery, are not detailed in the drawings because they are common and easily configurable/variable. Additionally, the disclosed architecture is sufficiently configurable, such that it may be utilized in ways other than what is shown.

DETAILED DESCRIPTION OF INVENTION

The embodiments of the present invention comprise a portable light device with a flexible reflector structure, more specifically described below. The invention, through embodiments, is an alternative to the use of cigarette lighters that can and will burn thumbs or fingers with prolonged usage; or expensive cell phones that the individual has the potential to drop and crack, which can or may require costly repairs, and/or having the individual to go days, if not weeks without their phone, or their phone can be lost or stolen in the crowd; or, minimize some of the extreme and exhaustive yelling and screaming that can leave a person's voice horse and their throat sore, or exhaustive clapping that can hurt the hands, all of which are currently being used and experienced by audience participants while praising and showing love for artists or performers, at concerts, events, and gatherings, for example. Comparable items currently available are designed like extending tubes or batons that are not a convenient size to transport, or have ridged fibers or bristles that can poke or stab, or are in the form of a sword or otherwise bulky, large, or long object which generally increases the risk of unwanted contact in crowds.

A floppy, dangly, flexible reflector structure of the embodiments of the present invention has a low risk of injury to self or others and can be used in a wide variety of situations, for example: indoor or outdoor events, concerts, performances, worship services, pep rallies, sport events, parks, theme parks, zoos, to signal to a bus or cab, auctions or charity bidding, as party favors, as a dance/cheerleader routine prop, for rural area signaling, emergency or distress signaling, as an attention getter, etc., In several embodiments, the invention is small enough to fit into a pocket or purse, which will promote convenience of use and lend itself to be taken along to different venues, time and time again without the necessity and added cost to repurchase another device where saving money is a factor.

In this Specification, which includes the figures, claims, and this detailed description, reference is made to particular and possible features of the embodiments of the invention, including method steps. These particular and possible features are intended to include all possible combinations of such features, without exclusivity. For instance, where a feature is disclosed in a specific embodiment or claim, that feature can also be used, to the extent possible, in combination with and/or in the context of other aspects and embodiments of the invention, and in the invention generally. Additionally, the disclosed architecture is sufficiently configurable, such that it may be utilized in ways other than what is shown.

The purpose of the Abstract of this Specification is to enable the U.S. Patent and Trademark Office and the public generally, and especially the scientists, engineers and practitioners of the art who are not familiar with patent or legal terms or phrasing, to determine quickly from a cursory inspection the nature and essence of the technical disclosure of the application. The Abstract is not intended to be limiting as to the scope of the invention in any way.

In the following description, numerous specific details are given in order to provide a thorough understanding of the present embodiments. It will be apparent, however, to one having ordinary skill in the art, that the specific detail need not be employed to practice the present embodiments. On other instances, well-known materials or methods have not been described in detail in order to avoid obscuring the present embodiments. When limitations are intended in this Specification, they are made with expressly limiting or exhaustive language.

Reference throughout this Specification to "one embodiment", "an embodiment", "one example" or "an example" means that a particular feature, structure, or characteristic described in connection with the embodiment or example is included in at least one embodiment of the present embodiments. Thus, appearances of the phrases "in one embodiment", "according to an embodiment", "in an embodiment", "one example", "for example", "an example", or the like, in various places throughout this Specification are not necessarily all referring to the same embodiment or example. Furthermore, the particular features, structures, or characteristics may be combined in any suitable combinations and/or sub-combinations in one or more embodiments or examples.

The terms "comprises", "comprising", "includes", "including", "has", "having", "could", "could have" or their grammatical equivalents, are used in this Specification to mean that other features, components, materials, steps, etc. are optionally present as a non-exclusive inclusion. For instance, a device "comprising" (or "which comprises") components A, B, and C can contain only components A, B, and C, or can contain not only components A, B, and C but also one or more other components. For example, a method comprising two or more defined steps can be carried out in any order or simultaneously, unless the context excludes that possibility; and the method can include one or more other steps which are carried out before any of the defined steps, between two of the defined steps, or after all the defined steps, unless the context excludes that possibility.

Further, unless expressly stated to the contrary, "or" refers to an inclusive or and not to an exclusive or. For example, An embodiment could have optional features A, B, or C, so the embodiment could be satisfied with A in one instance, with B in another instance, and with C in a third instance, and probably with AB, AC, BC, or ABC if the context of features does not exclude that possibility.

Examples or illustrations given are not to be regarded in any way as restrictions on, limits to, or express definitions of any term or terms with which they are utilized. Instead, these examples or illustrations are to be regarded as being described with respect to one particular embodiment and as being illustrative only. Those of ordinary skill in the art will appreciate that any term or terms with which these example or illustrations are utilized will encompass other embodiments, which may or may not be given in this Specification, and all such embodiments are intended to be included within the scope of that term or terms. Language designating such nonlimiting examples and illustrations includes, but is not limited to "for example", "for instance", "etc.", "or otherwise", and "in one embodiment."

The phrase "at least" followed by a number is used to denote the start of a range beginning with that number, which may or may not be a range having an upper limit, depending on the variable defined. For instance, "at least 1" means 1 or more.

In this specification. "a" and "an" and similar phrases are to be interpreted as "at least one" and "one or more." In this specification, the term "may" or "can be" or "could be" is to be interpreted as "may, for example." In other words, the term "may" is indicative that the phrase following the term "may" is an example of one of a multitude of suitable possibilities that may, or may not, be employed to one or more of the various embodiments.

The phrase "a plurality of" followed by a feature, component, or structure is used to mean more than one, specifically including a great many, relative to the context of the component. For example, "a plurality of reflectors" means more than one, and specifically includes more than a few and at least one embodiment of the invention includes hundreds of reflectors on one device.

It is the applicant's intent that only claims that include the express language "means for" or "step for" be interpreted under 35 U.S.C. § 112. Claims that do not expressly include the phrase "means for" or "step for" are not to be interpreted under 35 U.S.C. § 112.

The disclosure of this patent document incorporates material which is subject to copyright protection. The copyright owner has no objection to the facsimile reproduction by anyone of the patent document or the patent disclosure, as it appears in the Patent and Trademark Office patent file or records, for the limited purpose required by law, but otherwise reserves all copyright rights whatsoever.

The term "flashlight" means a common and well-known device that has several standard designs and is easily acquired at many online and retail stores for a nominal or higher fee, depending on the size, quality of the material and manufacturing, as well as the brand or maker. In British English, flashlights are often called "torches." Flashlights often have a member, battery, light-source (light-emitting unit, lamp and cover), and switch, but can come with a variety of other features. Clearly, there is an electrical component needed to connect the battery to the light source and the switch, which is common and known. This electrical component should be inferred from the context of the technology and will not be described, as it is well-known to a person of ordinary skill in the art. Another point of clarity, while flashlight is used in the context of the claim language, and this and the following flashlight paragraphs are definitions for those uses/elements/limitations, this Specification also defines the broader concept of a portable light with a handle. In this broader concept, as seen below, the "light" is a component of the "body", and the "light" includes, where applicable: a battery, light-emitting unit, lamp, cover, switch, and electrical circuits. An effort has been made to differentiate the terminology and be consistent (e.g. using 'member' for a flashlight body, 'housing' for the mid-breadth concept, and 'body' for the broad concept) where there are terms with in broader terms, but be aware of the overlap of subject matter.

A flashlight "member" can be a variety of different shapes, such as bodies with cylindrical tubes, rectangular or triangular prisms, spheres, or blocks with handles, for example. They can be further shaped, crafted, or molded to resemble particular objects. They can be made of plastic, steel, wood, or other materials, but aluminum is common as a material as it is lighter than steel and more durable than plastic. Surfaces for flashlight members, where the device may be gripped by the user, can be smooth, cross-hatched, rubbery, or otherwise textured. Flashlights are made in a range of sizes and weights, depending on their purpose; for example, some are made to be very small and portable for the occasional use, while others are large and heavy for sustained and intentional use. There are many aluminum LED mini-flashlights on the market, like the WDTPRO®, which are numerous and readily acquired.

The "battery" of a flashlight could be large or small, using single or multiple battery units, in conjunction with other power-generating sources like solar, shake, crank, winding, and others, or not. Batteries of flashlights could be internal to the member of the device, integrated with the light, externally mounted, or even magnetically attached. Batteries can be of different materials, shapes, and sizes; and can be permanently fixed in the device as a single-use or capable of re-charging, or could be replaceable/removable from the device.

The "light-source" of a flashlight can be recessed into the member, protruding with or without a lip or covering, mounted as a cone or bowl, or otherwise externally integrated, for example. The light-source of a flashlight is generally comprised of: light-emitting unit(s), a lamp, and a cover. A light-source can be in a variety of sizes and configurations, and can have a single light-emitting unit or comprised of several. A light-emitting unit can be an incandescent bulb, florescent, neon, light-emitting diode (LED), chemical reaction, including bioluminescence, heat, or flame, for example. A light-source usually includes a lamp, which is most commonly some sort of reflective bowl used to direct the light emitted in a particular direction or beam, but the light emitting unit could also be a bare bulb or LED without a lamp, or a planar disc of reflective material behind or underneath the light-emitting unit. If a light-source has many light-emitting units, each one could have a lamp, configured as a whole or independently. A light-source usually includes a cover over the light-emitting unit, as a way to protect the light-emitting unit, create colors or patterns or effects with the light beam, and/or further direct the beam of light from the light-emitting unit. Covers can be clear, opaque, and in a variety of patterns or colors. Covers are often flat discs over a light-emitting unit, but can also be shaped in particular ways, like a ball, popular figure, animal, food, or other shapes.

Flashlights generally have a "switch", but it is not required and there are other ways to (un)/complete the circuit between the battery and the light-source. Switches on flashlights can be one button or a series of buttons, toggles or switches flipped or slid from one position or another or more, or by twisting the body, for example. They can be made of plastic, metal, rubber, or a combination of materials. Switches can also be dimmers or change between different features of functions, like flashing, different colors, different combinations or number of light-emitting units, or different strengths of light (lumens). The most common switch in the current market for hand-held flashlights is a rubbery on/off button; if the flashlight has a cylinder-shaped body, the switch could be located on the side of the tube in easy reach of a thumb, or on the bottom end to be used with an underhanded grip. And older common switch style is a plastic bar that a user would slide up or down the shaft of the flashlight member to toggle the switch on or off.

Flashlights can have other features that are readily found in the wide variety of flashlights available for sale. Some flashlights have loops, loopholes, lanyard, or clamps, some can be strapped around other objects or body parts. Flashlights can have compasses, caches for matches or small objects, or even radio receivers.

FIG. 1 illustrates an embodiment of the invention, a portable light device 5 in the form of a smaller flashlight with a reflector structure, according to one embodiment, being waved and in use displaying light emitted 31 from the device. The device comprises a body 10 and a reflector structure 40. The body 10 comprises a first end 15 and a second end 25. The first end 15 having a handle 20, which could be in the form of a housing 11 with an exterior 21 shaped and sized to be held by a hand of a user. The second end 25 having a light 30 with an outer edge 35 around the light 30. The reflector structure 40 having a joined part 45 and a flexible part 50. The joined part 45 of the reflector structure 40 being coupled to the second end 25 of the body 10 around the outer edge 35 of the light 30. In the embodiment illustrated in FIG. 1, the joined part 45 is an adhesive wrap 46, and outside of the adhesive wrap 46 is a decorative band 47. There can be reflective pieces 48 on the decorative band 47, as also seen in the variety of embodiments illustrated in FIGS. 4*a*, 4*b*, 4*c*, and 4*d*. As shown in more detail in the embodiment illustrated in FIG. 2 and FIG. 3, the flexible part 50 of the reflector structure 40 comprises a flexible base 55 and at least one reflector 60, or a reflective material for the surface of the flexible base 55, or a plurality of reflectors 61 attached to the flexible base 55, as illustrated in other figures. The flexible base 55 can be further defined in different embodiments of the invention as being a flexible skirt 56. The flexible skirt 56 could be comprised of flexible strips 57. The flexible skirt 56 could also be defined as being of a fabric material. A bell 66 can be included in an embodiment of the invention, as well as a switch 65, or a wrist strap 67, depending on the user's personal taste.

Figure 2:
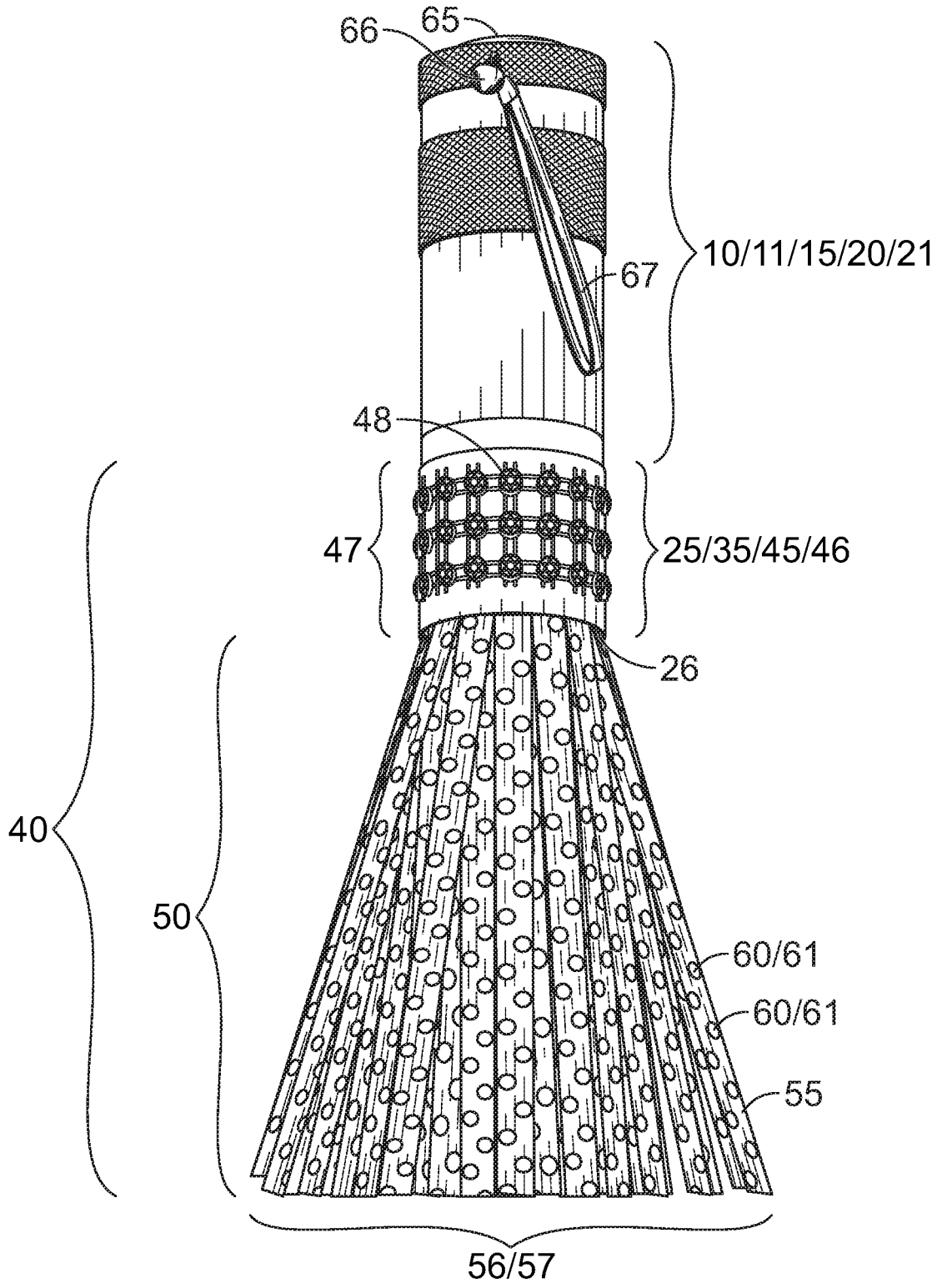
FIG. 2 is a front perspective of an embodiment of the invention in a nearly-vertical position, to show the curvature of the cylindrical body in this embodiment.
Figure 3:
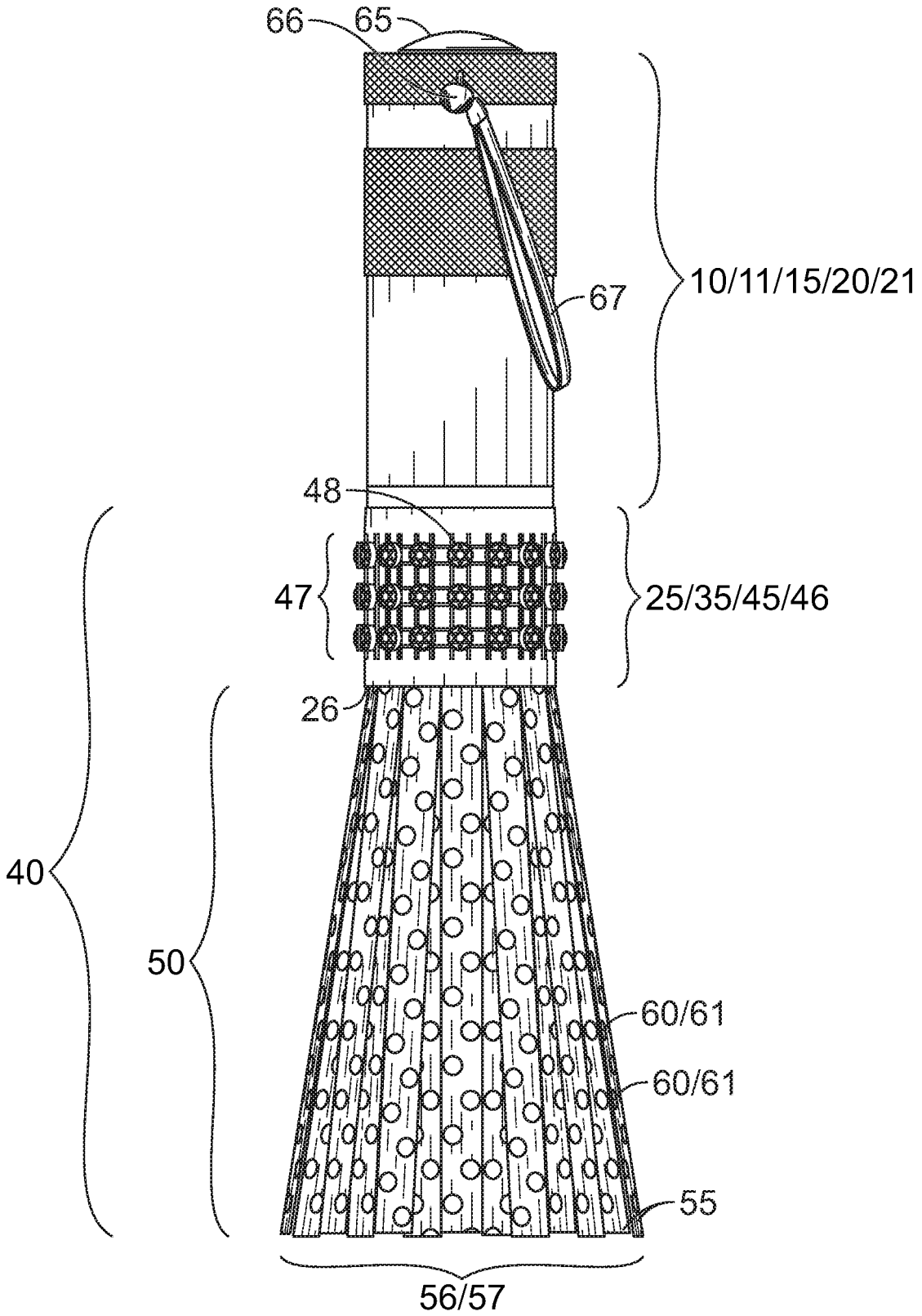
FIG. 3 is a front perspective of an embodiment of the invention in a vertical position.
Figure 4A:
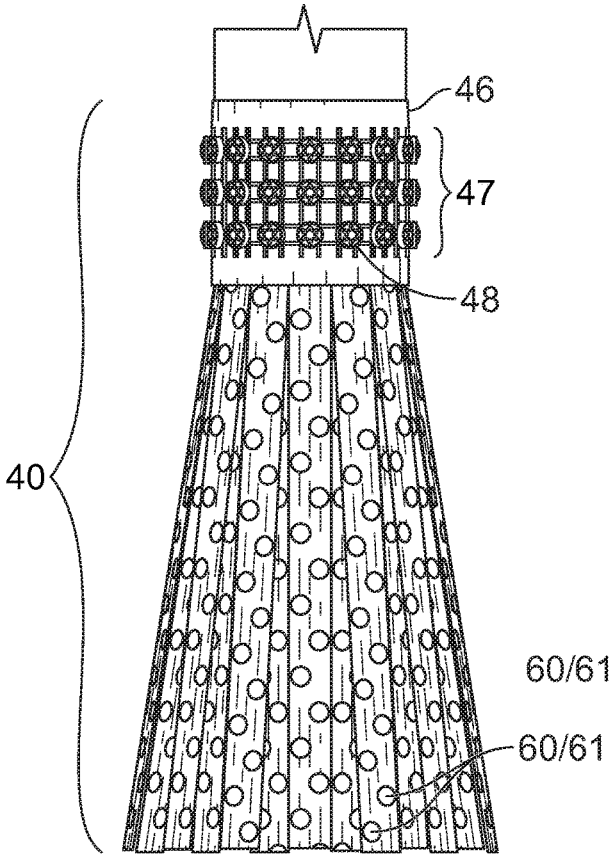
FIGS. 4*a*, 4*b*, 4*c*, and 4*d* are partial views of several possible embodiments of the reflector structure, showing different reflectors and different decorative bands.
Figure 4B:
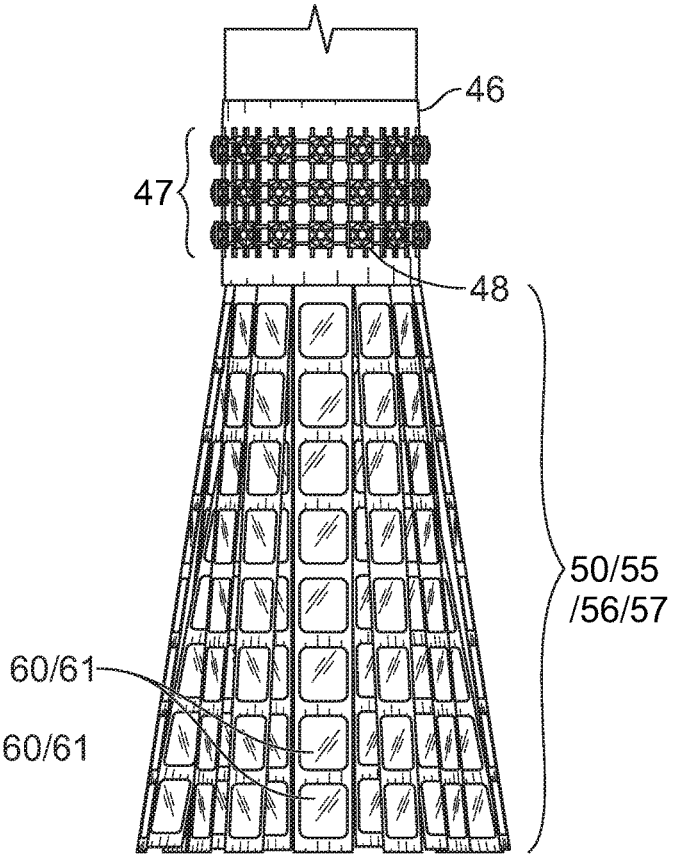
Figure 4C:
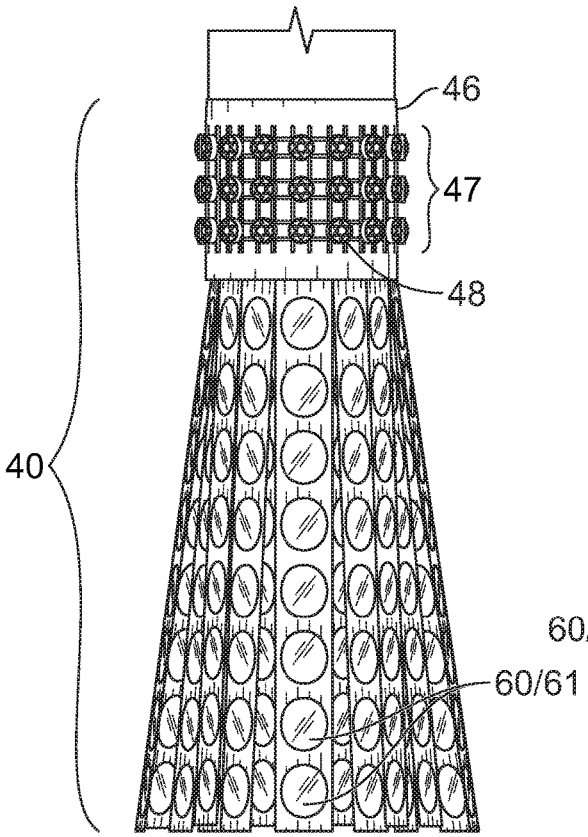
Figure 4D:
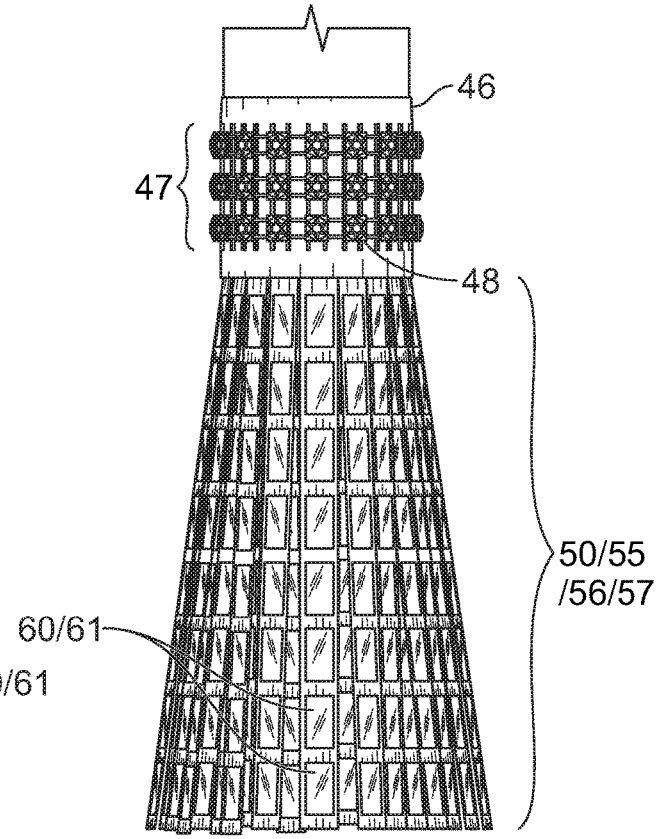

FIG. 2 and FIG. 3 are front perspectives of larger embodiments of the invention showing that the flexible base 55 of the flexible part 50 of the reflector structure 40 has at least one reflector 60, or a reflective material and/or fabric material for the surface of the flexible base 55, or a plurality of reflectors 61 attached to the flexible base 55, as illustrated in other figures.

The partial views of FIG. 4*a*, FIG. 4*b*, FIG. 4*c*, and FIG. 4*d* illustrate several embodiments for at least one reflector 60 and up to a plurality of reflectors 61 that are attached to the flexible base 55, and possible embodiments of corresponding decorative bands 47 and reflective pieces 48. The flexible strips 57 that could comprise the flexible skirt 56, are shown in several embodiments.

Figure 5:
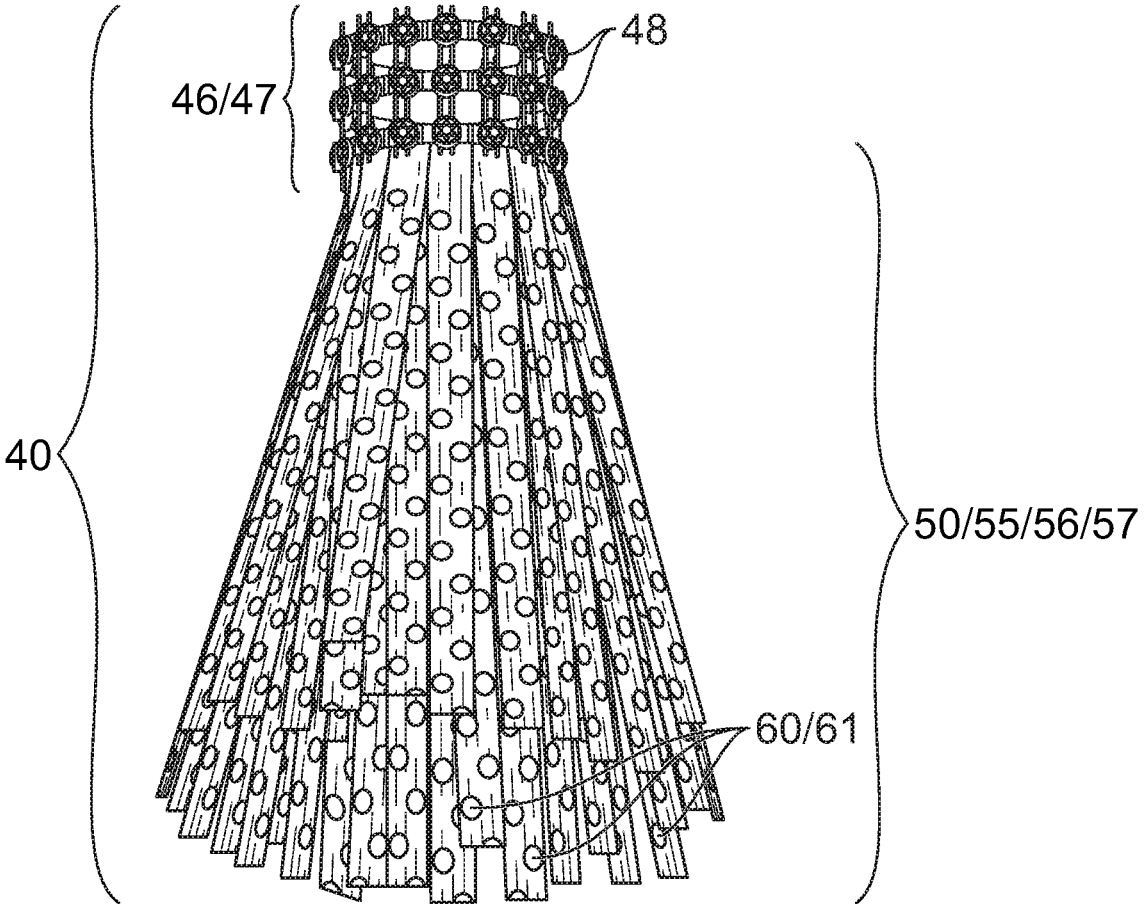
FIG. 5 is a partial view of an embodiment of the reflector structure, showing differing lengths of flexible strips and where the decorative band could also be the adhesive wrap.

FIG. 5 is a partial view showing different embodiments of the reflector structure 40 of the invention. The joined part 45 of the reflector structure 40 is coupled to the outer edge 35 (as in FIG. 1-3) around the light 30 (as in FIG. 1). The adhesive wrap 46 in this embodiment is the decorative band 47, if/when the decorative band 47 is used directly to join the reflector structure 40 to the outer edge (as in FIG. 1-3) of the light (as in FIG. 1). Another aspect of this embodiment is that the decorative band 47, acting as the adhesive wrap 46 of the joined part 45, operates to directly secure the flexible part 50 of the reflector structure 40 to the joined part 45 of the reflector structure 40. Additionally, the flexible skirt 56 of this embodiment has differing lengths of flexible strips 57, as the flexible skirt 56 need not be uniform in length.

Figure 6A:
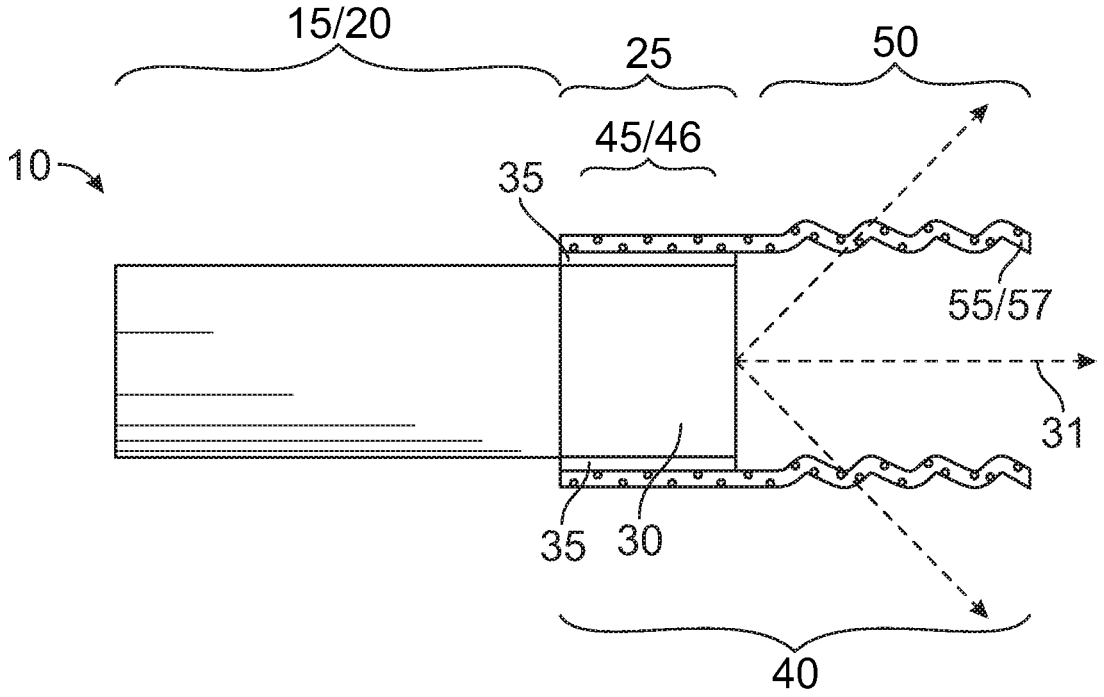
FIGS. 6*a* and 6*b* are diagrams of the general inventive concept, with FIG. 6*a* showing a possible embodiment of the invention where the light is a part of the body, not necessarily integrated inside of it.

FIG. 6*a* is a general diagram, illustrating a possible embodiment of the invention where the light 30 is a part of the body 10, but not necessarily integrated inside of it. The first end 15 of the body 10 is suitable for being a handle 20. The second end 25 of the body 10 is the light 30. The joined part 45 of the reflector structure 40 is coupled to the outer edge 35 around the light 10, and is shown in this embodiment as also the adhesive wrap 46. FIG. 6*a* illustrates how the light emitted 31 from the light 30 might interact with the flexible part 50 of the reflector structure 40, which would be floppy and moving around while in use. The flexible part 50 could also be flexible strips 57.

Figure 6B:
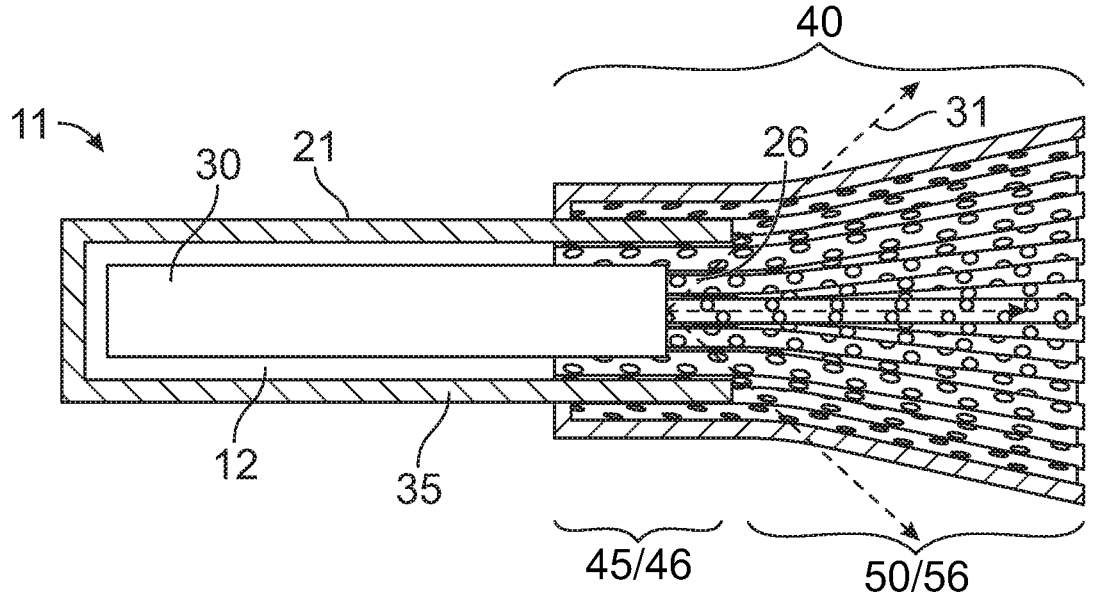

FIG. 6*b* diagrams another possible embodiment with a light 30 inside a hollow housing 11 body 10, and a flexible skirt 56 with pleated flexible base 55 rather than flexible strips 57 (as seen in FIG. 6*a*). The housing 11 has an exterior 21 shaped and sized to be held by a hand of a user, a hollow interior 12, and an open end 26, the open end 26 defining the second end 25 of the body 10; the light 30 being mounted in the hollow interior 12 of the housing 11 to emit light 31 outwardly from the open end 26 of the housing 11 in a generally longitudinal axis direction, and the outer edge around 35 the light 30 is the exterior 21 of the open end 26 of the housing 11. This Specification will now proceed to describe in detail the elements of the embodiments of the invention.

Portable light device 5 means a generic term for embodiments of the invention, which includes a body and a reflector structure, and is portable.

Body 10 means the body, frame, housing, handle, member, form, article, pipe, tube, piece, segment, structure, primary mass of the device, and could also be a common "flashlight" or flashlight "member" as defined above. At its most basic embodiments, the body includes a handle, or other way for a user to hold the embodiments of the invention, and a light component. It takes at least a body attached to a flexible reflector structure to make embodiments of the portable light invention. The body could also include a flashlight "switch", as defined above, or other flashlight accessories. In an embodiment, the body provides the handle on the first end of the body, and on the second end of the body there is an open end within which to internally mount the light. In another embodiment, the handle portion of the body could be more than half of the body structure/size/mass, and the light portion of the body would be less than half of the total body structure. In still another embodiment, the light portion of the body could account for more than half of the body's structure, and the handle portion of the body would be less than half of the body. In yet another embodiment the handle and the light portions could account for equal space of the body. In another embodiment, the handle and the light portions of the body could share space or otherwise be intermingled, multi-functional parts rather than distinctly separable parts, but given the nature and purpose of the invention, one part would emit light from the light component and the user's hand would need to be able to hold the device so that the beam of light from the device is not blocked sufficiently to inhibit display. In smaller embodiments, the body could be only large enough for the light component, with the handle being rubber gripping strips along the back. The invention may come in large embodiments, but it needs to be within the limits of portability for a human user.

Housing 11; means a further limitation of the body, in that it could be any of the given possible options for the body, including a flashlight "member" as defined above, as long as it includes a hollow interior. In an embodiment, the housing provides the handle on the first end of the body, and an open end on the second end of the body within which to internally mount the light. In another embodiment, the handle portion of the housing could be more than half of the housing structure, and the light portion of the housing would be less than half of the total housing structure. In still another embodiment, the light portion of the housing could account for more than half of the housing structure, and the handle portion of the housing would be less than half of the housing. In yet another embodiment the handle and the light portions could account for equal space of the housing. In a smaller embodiment, the housing could be just large enough for the light component, with the handle being the back of the housing fit into the palm of a user's hand.

Hollow interior of housing 12 means the inside space of the housing of an embodiment of the invention. The hollow interior of the housing could be a variety of shapes and sizes, and still be able to mount the light. In one embodiment, the hollow interior could be relative to the shape and size of the housing. In another embodiment, the hollow interior could be much smaller or differently shaped than the housing structure. While the light (see also flashlight "light-source" definition above) is to be mounted into the hollow interior of an embodiment of the invention, it need not conform to the size or shape of the light if the light can be securely mounted nonetheless; the hollow could be larger than needed for the light and its components, or smaller than all the components because the light is mounted to extend some components outward (e.g. the housing shape flares out at the end to accommodate a larger lamp). In an embodiment, the components of the light could be arranged through the hollow interior to facilitate different body shapes. In another embodiment, the light could be entirely contained in the hollow interior as to be indistinguishable from the housing body and fully integrated.

First end of body 15 and handle 20 means the part of the body that is not where the beam of light is emitted, and is oriented such that a user can hold an embodiment of the invention by the first end and display the light.

Exterior of housing 21 means the outer surface of the housing, distinct from the interior of the housing, and includes embodiments that are "flashlights", flashlight "members", and the housing, as defined above. When an embodiment of the invention includes a hollow housing, it must necessarily have an interior and exterior.

Second end of body 25 and light 30 means the part of the body that is capable of creating light and the components that serve that function, as distinct from the housing or structural components of the body. Also means a flashlight "light-source" (which includes the descriptions for a lamp, cover, and light-emitting unit) and "battery", electrical components to create a circuit, and can include a flashlight "switch", the light is a component of the body, and includes, where applicable: a battery, light-emitting unit, lamp, cover, switch, and electrical circuits. An effort has been made to differentiate the terminology and be consistent (e.g. using 'member' for a flashlight body, 'housing' for the mid-breadth concept, and 'body' for the broad concept) where there are terms with in broader terms, but be aware of the overlap of subject matter.

Open end 26 means the open side of a body, including a flashlight "member", where the exterior of the housing is absent, and the hollow interior of the housing would be exposed if the light were removed or not mounted or otherwise attached. The side of the body where the beam of light is emitted. This is distinct from a temporary opening that could be accessed by the user to replace bulbs or batteries, for instance; though in some embodiments, a user would unmount, unscrew, or otherwise remove the light-source in order to do so. Accessing the body or the flashlight is not detailed in this Specification as that is a common feature/function for the art that a person of ordinary skill would not need additional information for in order to practice the embodiments of the invention.

(Beam of) Light emitted from the device 31 is to be taken in its plain and common meaning, and includes light emitted from a light and a "flashlight" and a "light-source". Light emitted can be of different strengths/lumens, from very dim and barely discernable to the human eye, to very bright but preferably not so bright as to hurt or injure anyone's eyesight. The light emitted could be range of different colors or pattern of colors. The beam of light emitted could create its own patterns or project an image, if desired in an embodiment.

Outer edge around light 35 means the physical lip, ledge, sides, sidewalls, shell, or material otherwise surrounding, protecting, encasing the components of the light. This is regardless of whether the body or flashlight "member" or light casing is rounded or flat-sided. Around means located or situated on every side, not necessarily on the literal outside perimeter of the outer edge structure, but should also include the outer edge structure itself and inside the outer edge structure, as all are around the outer edge of the light. Around is not necessarily continuous; for example, in an embodiment with flexible strips the strips could be attached with spaces or gaps from one strip to the next, in patterns or at random, and the strips would be around the outer edge without literally covering all edge material. The outer edge could be integrated with the cover, in embodiments where there is a cover with the light structure.

Reflector structure 40 means the part of the embodiments of the invention that comprises a joined part to the body and a flexible part that has a flexible base and reflective components. It is the part that is added to a "flashlight" or body to form an embodiment of the invention.

Joined part of reflector structure to body 45 means the part of the reflector structure that attaches the reflector structure to the body or "flashlight". The joined part could be tape, glue, epoxy, tight strapping or cord, rubber or silicon bands, metal or plastic bands, for instance. In an embodiment of the invention, the joined part can be of the same material as the flexible part or flexible base of the reflector structure with an added adhesive or joining component. In another embodiment, the joined part could be a different material from the flexible part of the reflector structure, and have adhesive or joining capability. Chiefly, the joined part needs to be of sufficient length to be secured to the body, which will depend on the context of the particular embodiment. In another embodiment, the joined part could be secured between the inside of the outer edge of the light and the light.

Adhesive wrap 46 means a further limitation of the joined part where the joined part is achieved by wrapping a band of material with adhesive capability around the open end of the light in order to secure the flexible part of the reflector structure. In one embodiment, the flexible part is placed around the outer edge of the light in the position desired to create the reflector structure, then the flexible part is secured to the light by common electrical tape or duct tape. In another embodiment, the flexible part is placed around the outer edge of the light in the position desired to create the reflector structure, then the flexible part is secured to the light by an epoxy-coated fabric which then dries to complete the joining together.

Decorative band 47 means an ornamental component that could be added to or over the adhesive wrap or joined part to make the device more attractive, stylish, shiny, or colorful. The decorative band could be made of or contain: rhinestones, diamonds, crystals, reflective discs, coins, sparkling fabric, faux-fur, velvet or velvet-like fabric, metallic-like materials, glitter, flowers, feathers, stickers, specific shapes or charms, or any number of decorative pieces that a user would subjectively find pleasing on their device. The decorative band could even be its own light-emitting device with mini-LEDs or the like.

Reflective pieces 48 means elements on the decorative band that are specifically reflective or shiny, as listed above. The reflective pieces could be applied individually or come pre-assembled in an array or patterns. The reflective pieces could be arranged to spell a word or name, or convey a shape or design. This is a matter of personal taste, but the intent is to add to the reflective characteristics and effect of an embodiment of the invention.

Flexible part of reflector structure 50 means the flexible, dangly part of the reflector structure, that comprises a flexible base and reflector(s), as further defined.

Flexible base of flexible part 55 means the base material that is the structural component of the flexible part of the reflector structure shape. The flexible base needs to be flexible material, like rubber sheeting, plastic, silicon, fabric, or other materials that are bendable and movable, but could be capable of holding itself up as long as it gave way if pushed into a bag for transport or waved around sufficiently to reflect light from the reflector(s) when in use. In one embodiment, a soft, reflective fabric is used that has reflective or shiny threads woven into other threads. In another embodiment, a soft fabric with a plurality of plastic reflectors securely attached could flop around the beam of light emitted in a free and wild way when an embodiment of the invention is in use by a user. The length and size of the flexible base will depend on the context of the specific embodiment, but should be at least long enough to allow the reflective parts of the reflective base to interrupt the beam of light emitted from the light, and should be short enough to not become tangled with standard use or transport. In one embodiment, the flexible base could extend out more than twice the length of the body of the device. In another embodiment, the flexible base could be as short as the radius of the cover of the light of the device. The fabric could be itself reflective or have reflective components integrated into it, rather than relying on separate reflector pieces being attached.

Flexible skirt 56 means the flexible base is arranged in a skirt-like configuration from the outer edge of the light, in that it can flare outward at the free end if spun. The flexible skirt could be pleated or not, could be comprised of strips or wedges of the flexible base material, could be continuous or have spaces/gaps/holes in the flexible base.

Flexible strips 57 means a further limitation of the flexible skirt where the skirt is strips of the flexible base material that can move independently when the device is used. The strips need not be simple rectangles of material, but could have their own patterns, edging, holes, fraying, scalloping, lattice or lace work, or other variations. The strips could be fat or thin in width, or could be fatter at one end than the other.

Fabric material means the common and plain meaning of fabric that might come into use by or contact with humans. Fabric material is a further limitation of the flexible base and flexible skirt where the material of the structure is a fabric. Fabric material is generally woven, either by machine or hand. Fabric can be from animal or plant or synthetic fibers, and can be a mix or blend of several types of fibers. Fabric is thinner and more flexible than say, silicon material that might be used for the same feature. Fabric can usually be creased or folded without damage or breaking, returning to its original configuration.

Reflective material means that the reflective base of the reflective skirt is itself reflective and thereby provides its own reflectors. Reflective material could be fabric with reflective thread in whole or in part, or an outer sheath of flexible foil or other material with reflective properties that could be applied to the reflective base, reflective paint or glitter applied to the reflective base, or integrated pieces of the reflective material that otherwise has reflective properties.

A reflector attached to flexible base 60 and a plurality of reflectors 61 means an object or objects that are reflective or shiny, and could be made of: rhinestones, glass, plastic, diamonds, crystals, reflective discs, coins, sparkling fabric, foil or metallic-like materials, glitter, stickers, or other objects that are reflective. The reflectors can be many sizes and shapes, depending on the context of the embodiment and the intended user. In some embodiments, the reflectors on the flexible base aesthetically match the reflective pieces of the joined part. Reflectors can have profiles that are flat, domed, plateaued, rounded, protruding, or flush. Reflectors can be attached to the inside, light-facing side of the reflective base, the outward-facing side of the reflective base, or both. One side could have one selection of reflectors while the other side has a different selection of reflectors. There could be several different selections of reflectors on one embodiment. Reflectors could be placed in a uniform manner on the retlective base or be patterned or random, or even spell out words or be configured into certain shapes. Reflectors could be placed on the furthest end from the light, up to the light, or anywhere in between on the reflective base.

Switch 65 means a common switch, as defined in flashlight "switch" above.

Bell 66 means a common bell. Bells come in a variety of shapes and sizes and generally have a metal sphere or clap to hit the body of the bell to create a vibration or audible ringing, the sphere style is usually loose in a spheroid-shaped bell body, while the clap style is usually attached to the depths of a classic bell-shaped body. The size should be reasonable to the size of the particular embodiment, and the color or other decorative features are numerous and common.

Wrist strap 67 means a lanyard or loop that is convenient to place around a user's wrist so that if they release the embodiment of the device, it will not drop and break.

One embodiment example is a portable light device, comprising: a body and a reflector structure; the body having a first end and a second end, the first end having a handle, and the second end having a light with an outer edge around the light; and the reflector structure having a joined part and a flexible part, the joined part being coupled to the second end of the body around the outer edge of the light, and the flexible part having a flexible base and at least one reflector attached to the flexible base.

A second embodiment example is the portable light device of example one, wherein the body further comprises: a housing with an exterior shaped and sized to be held by a hand of a user, a hollow interior, and an open end, the open end defining the second end of the body; the light being mounted in the hollow interior of the housing to emit light outwardly from the open end of the housing in a generally longitudinal axis direction, and the outer edge around the light is the exterior of the open end of the housing.

A third embodiment example is the portable light device of example one, wherein the light further comprises a light-emitting diode (LED).

A fourth embodiment example is the portable light device of example one, wherein the body comprises an aluminum flashlight.

A fifth embodiment example is the portable light device of example one, wherein the flexible base of the flexible part of the reflector structure comprises a flexible skirt.

A sixth embodiment example is the portable light device of the fifth example, wherein the flexible skirt further comprises flexible strips.

A seventh embodiment example is the portable light device of the fifth example, wherein the flexible skirt comprises a fabric material.

An eighth embodiment example is the portable light device of the fifth example, wherein the at least one reflector is a plurality of reflectors, each attached to the flexible base.

A ninth embodiment example is the portable light device of the fifth example, wherein the flexible base of the reflector structure comprises a reflective material.

A tenth embodiment example is the portable light device of example one, further comprising an adhesive wrap securely coupling the joined part of the reflector structure with the outer edge of the light of the second end of the body.

An eleventh embodiment example is the portable light device of the tenth example, wherein the joined part of the reflector structure comprises a decorative band.

A twelfth embodiment example is the portable light device of the eleventh example, wherein the decorative band comprises reflective pieces.

A thirteenth embodiment example is a hand-held flashlight having a body, battery, light, and switch, the improvement comprising: flexible strips protruding outwardly from around the light-emitting end of the body of the flashlight so that they dangle and move freely, and reflectors attached to the flexible strips.

By example, a method for displaying light, comprising the steps of: holding the portable light device of the first or thirteenth example, turning on the light device, shaking and waving the device so that the reflectors on the flexible part of the device interrupt the beam of light from the device and reflect some of the light in a random plurality of directions.

What is claimed is:

1. A portable light device, comprising:

a body and a reflector structure;

the body having a first end and a second end, the first end having a handle, and the second end having a light with an outer edge around the light; and the reflector structure having a joined part and a flexible part, the joined part being coupled to the second end of the body around the outer edge of the light, and the flexible part having a flexible base and at least one reflector attached to the flexible base, wherein light reflects off the flexible part and does not pass through.

2. The portable light device of claim 1, wherein the body further comprises:

a housing with an exterior shaped and sized to be held by a hand of a user, a hollow interior, and an open end, the open end defining the second end of the body;

the light being mounted in the hollow interior of the housing to emit light outwardly from the open end of the housing in a generally longitudinal axis direction, and the outer edge around the light is the exterior of the open end of the housing.

3. The portable light device of claim 1, wherein the light further comprises a light-emitting diode (LED).

4. The portable light device of claim 1, wherein the body comprises a flashlight.

5. The portable light device of claim 1, wherein the flexible base of the flexible part of the reflector structure comprises a flexible skirt.

6. The portable light device of claim 5, wherein the flexible skirt further comprises flexible strips.

7. The portable light device of claim 5, wherein the flexible skirt comprises a fabric material.

8. The portable light device of claim 5, wherein the at least one reflector is a plurality of reflectors, each attached to the flexible base.

9. The portable light device of claim 5, wherein the flexible base of the reflector structure comprises a reflective material.

10. The portable light device of claim 1, further comprising an adhesive wrap securely coupling the joined part of the reflector structure with the outer edge of the light of the second end of the body.

11. The portable light device of claim 10, wherein the joined part of the reflector structure comprises a decorative band.

12. The portable light device of claim 11, wherein the decorative band comprises reflective pieces.

13. A hand-held flashlight having a body, battery, light, and switch, the improvement comprising:

flexible strips protruding outwardly from around the light-emitting end of the body of the flashlight so that they dangle and move freely, and reflectors attached to the flexible strips; wherein light reflects off the reflectors and does not pass through.

14. A method for displaying light, comprising the steps of:

holding the portable light device of claim 1 or 13, turning on the light device, shaking and waving the device so that the reflectors on the flexible part of the device interrupt the beam of light from the device and reflect some of the light in a random plurality of directions.

* * * * *